US005604175A

United States Patent [19]

Nakabayashi et al.

[11] Patent Number: 5,604,175

[45] Date of Patent: Feb. 18, 1997

[54] REVERSIBLE HEAT-SENSITIVE RECORDING MEDIUM

[75] Inventors: Yutaka Nakabayashi; Yoshihiro Hieda; Seiji Kondo, all of Osaka, Japan

[73] Assignee: Nitto Denko Corporation, Osaka, Japan

[21] Appl. No.: 240,528

[22] Filed: May 10, 1994

[30] Foreign Application Priority Data

May 11, 1993 [JP] Japan ..... 5-133897

[51] Int. Cl.[6] ..... B41M 5/26

[52] U.S. Cl. ..... 503/201; 428/195; 428/913; 428/914; 503/217

[58] Field of Search ..... 503/201, 217; 428/195, 913, 914

[56] References Cited

U.S. PATENT DOCUMENTS 4,977,030 12/1990 Hotta et al. ..... 428/447

FOREIGN PATENT DOCUMENTS 0506085 9/1992 European Pat. Off. ..... 503/201

0535930 4/1993 European Pat. Off. ..... 503/201

4017640 12/1990 Germany ..... 503/227

4019683 1/1991 Germany ..... 503/227

*Primary Examiner*—B. Hamilton Hess

*Attorney, Agent, or Firm*—Sughrue, Mion, Zinn, Macpeak & Seas

[57] ABSTRACT

A reversible heat-sensitive recording medium comprising (i) a resin matrix, (ii) at least one organic low molecular weight material (A) which is at least partially insoluble in the resin matrix, exists in the resin matrix by phase separation and is dispersed as particles in the resin matrix, and (iii) an organic low molecular weight material (B) soluble in the resin matrix, wherein the organic low molecular weight material (B) can impart an orientation to the melt of the organic low molecular weight material (A) at a temperature of from $T_1$ to $T_2$ (wherein $T_1$ is the melting point of the organic low molecular weight material (A) in the resin matrix, and $T_2$ is the melting point of the organic low molecular weight material (B) in the resin material).

9 Claims, 1 Drawing Sheet

FIGURE I
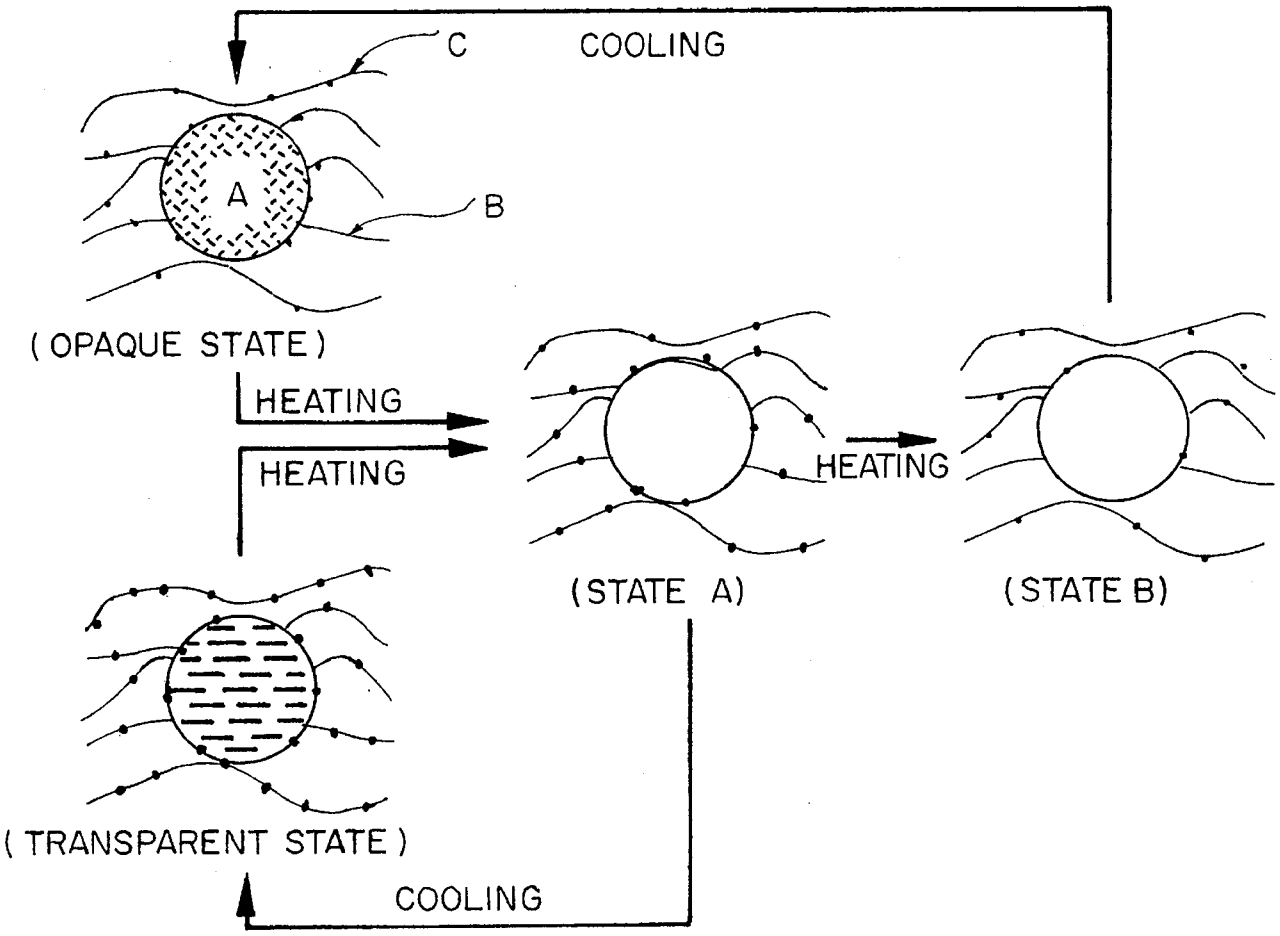

REVERSIBLE HEAT-SENSITIVE RECORDING MEDIUM

FIELD OF THE INVENTION

This invention relates to a reversible heat-sensitive recording medium which enables the formation and erasing of an image to be reversibly repeatedly conducted by a heating means such as a thermal head.

BACKGROUND OF THE INVENTION

The demand for heat-sensitive recording mediums has rapidly increased with the spread of thermal heads in recent years. Magnetic information is often displayed as visible information on prepaid cards which are rapidly spread in the fields of communication, transportation, distribution, etc, in particular. Such magnetic cards are widely used as highway cards, prepaid cards in department stores, supermarkets, etc., and JR orange cards.

However, the area on which visible information can be displayed is limited to only a part of the recording medium. For example, when the balance is recorded on a large denomination prepaid card, the case occurs that information is no more displayed. In this case, a new card is conventionally reissued. Accordingly, there is a problem that costs are increased.

Studies have been made to provide a reversible recording medium which enables recording and erasing to be repeatedly conducted on the same area to overcome the above-described problem. When the recording medium is used, previous unnecessary information can be erased, and new information can be displayed. Accordingly, it is not necessary that a new card is reissued when display is no more made. Further, when the recording medium is used as, for example, facsimile paper, resources can be saved, and the recording medium can contribute to the solution of environmental problems.

As the heat-sensitive recording mediums which enable the recording and erasing of information to be reversibly conducted, there have been conventionally proposed those having a heat-sensitive layer formed by dispersing an organic low molecular weight material such as a higher alcohol or a higher fatty acid in a resin matrix such as polyvinyl chloride, a vinyl chloride-vinyl acetate copolymer, a polyester or a polyamide (see, JP-A-54-119377 (the term "JP-A" as used herein means an "unexamined published Japanese patent application"), JP-A-55-154198 and JP-A-2-1363).

The principle of forming an image on the reversible heat-sensitive recording medium and erasing it therefrom is based on that the transparency of the heat-sensitive layer is different when the temperature of the heat-sensitive layer is raised to a different temperature, and restored to room temperature. Namely, when the temperature of the above-described recording medium is elevated to a predetermined temperature and then restored to room temperature, the recording medium shows a transparent state, while when the temperature thereof is elevated to a different temperature and then restored to room temperature, the recording medium shows an opaque state.

It is preferred that recording on the above-described heat-sensitive recording layer is made by a thermal head. It is preferred that erasing is made by a heated roll, a hot stamp or a thermal head.

However, when the use of general-purpose recording device is taken into consideration, it is preferred that erasing is made by using a thermal head. In this case, when the recording medium disclosed in JP-A-55-154198 are used, an erasable proper energy range is extremely narrow, and hence erasing cannot substantially be made.

JP-A-2-1363 proposes that the erasable energy range is widened by adding a high melting material as the second component for the organic low molecular weight material to overcome the above-described problem.

However, the recording medium has a problem that the apparent melting point of the high melting material is lowered and as a result, an erasable energy range cannot be sufficiently widened.

The present inventors have eagerly made studies to overcome the above-described problems and found that when a material capable of imparting orientation to the melt of a predetermined organic low molecular weight material is blended with the low molecular weight material, the above-described problems can be overcome. The present invention has been accomplished on the basis of this finding.

SUMMARY OF THE INVENTION

An object of the present invention is to provide a reversible heat-sensitive recording material which enables erasing to be conducted over a wide energy range and shows high transparency.

The present invention provides a reversible heat-sensitive recording medium comprising (i) a resin matrix, (ii) at least one organic low molecular weight material (A) which is at least partially insoluble in the resin matrix, exists in the resin matrix by phase separation and is dispersed as particles in the resin matrix, and (iii) an organic low molecular weight material (B) soluble in the resin matrix, wherein the organic low molecular weight material (B) can impart orientation to a melt of the organic low molecular weight material (A) at a temperature of from $T_1$ to $T_2$ (wherein $T_1$ is the melting point of the organic low molecular weight material (A) in the resin matrix, and $T_2$ is the melting point of the organic low molecular weight material (B) in the resin matrix).

BRIEF DESCRIPTION OF THE DRAWING

The FIGURE is a conceptual diagram for illustrating transparent-opaque mechanism.

DETAILED DESCRIPTION OF THE INVENTION

Conventionally, there are reports on X-ray diffraction data which suggest that aliphatic compounds (fatty acids) exhibit an ordered melt structure just above the melting points thereof (B. N. Tyutyunnikov, Izd. Pishchevaya Prom. Moskva (1966), N. Iwasaki et al., J. Phys. Chem. 95, 44 (1991)). The present inventors have obtained a reversible heat-sensitive recording medium having a practicable reversible recordability by improving erasability by combining a material capable of imparting orientation to the melt of the organic low molecular weight material with the organic low molecular weight material to thereby retain the orientation of the melt thereof.

The particles of the organic low molecular weight material (A) used in the heat-sensitive recording medium of the present invention are partially insoluble in the resin matrix, exist in the form of an island in the resin matrix by phase separation and form a phase called domain. Examples of the organic low molecular weight material (A) which can be used in the present invention include aliphatic compounds having an orientation just above the melting points thereof. The term "orientation" as used herein means that an X-ray image showing the parallel arrangement of the molecule can be obtained by X-ray diffraction.

The organic low molecular weight material (B) is dissolved in the resin matrix and exists on the outside of the organic low molecular weight material (A). The crystal of the organic low molecular weight material (B) is grown at a temperature of from $T_1$ to $T_2$ (wherein $T_1$ is the melting point of the organic low molecular weight material (A) in the resin matrix, $T_2$ is the melting point of the organic low molecular weight material (B) in the resin matrix, and $T_1<T_2$), and the organic low molecular weight material (B) imparts the orientation to the melt of the organic low molecular weight material (A). The melting points of the organic low molecular weight materials (A) and (B) in the resin matrix are lower than an inherent melting point of each of materials (A) and (B), and can be confirmed by a differential scanning calorimeter (DSC).

When the reversible heat-sensitive recording medium of the present invention is observed through a polarizing microscope and analyzed by X-ray diffractometry, it is considered that the organic low molecular weight material (B) imparts the orientation to the organic low molecular weight material (A) through the following mechanism.

Referring to the attached FIGURE showing a conceptual diagram for illustrating the transparent-opaque mechanism, the organic low molecular weight material (B) which is in the opaque state at ordinary temperature is dissolved in the resin matrix (C) and is not substantially crystallized. However, when the material is heated, crystallization proceeds, and the crystal is grown even when the temperature exceeds the melting point ($T_1$) of the organic low molecular weight material (A) in the resin matrix. As a result, the organic low molecular weight material (B) surrounds the particles of the organic low molecular weight material (A), whereby the orientation of the melt of the organic low molecular weight material (A) can be retained.

When a temperature in the region of from $T_1$ to a temperature lower than $T_2$ is cooled to room temperature, a transparent state is formed. Namely, since the melt of the organic low molecular weight material (A) has orientation, larger crystals are grown and as a result, a transparent state which hardly scatters light is obtained.

When a temperature in the region of $T_2$ or higher in the state B is cooled to room temperature, an opaque state is obtained. When the organic low molecular weight material (B) is heated to the melting point ($T_2$) thereof or higher, the material (B) is molten, and the orientation of the organic low molecular weight material (A) in the melt state can be no longer retained. When the medium in this state is cooled, the particles of the organic low molecular weight material (A) form the aggregate of small crystals, and hence interfaces which scatter light are increased, thereby forming an opaque state.

When the melt of the organic low molecular weight material (A) is combined with the organic low molecular weight material (B) capable of imparting the orientation thereto, the transparent erasing temperature range of the reversible heat-sensitive recording medium can be widened, and erasing can be made by a thermal head.

The constituent components of the recording medium of the present invention will be explained in greater detail below.

The resin matrix is used to form a layer containing the organic low molecular weight materials uniformly dispersed therein. The transparency of the recording layer in the transparent state is greatly affected by the resin matrix. Accordingly, resins having high transparency, stable mechanical properties and excellent film forming properties are preferred. Examples of the resins which can be used as the resin matrix include polyvinyl chloride, vinyl chloride copolymers such as a vinyl chloride-vinyl acetate copolymer, a vinyl chloride-vinyl acetate-vinyl alcohol copolymer and vinyl chloride-acrylate copolymers; polyvinylidene chloride, vinylidene chloride copolymers such as a vinylidene chloride-vinyl chloride copolymer and a vinylidene chloride-acrylonitrile copolymer; polyesters; polyamides; polyacrylates or polymethacrylates; thermoplastic resins such as acrylate-methacrylate copolymers, silicone resins, polystyrene, a styrene-butadiene copolymer; and other thermosetting resins. These resin matrixes may be used either alone or in combination of two or more of them.

Further, it is preferred that the resin matrixes can be heat-crosslinked by crosslinking agents to ensure the above-described object as well as to improve recyclability. Examples of the resin matrixes include vinyl chloride copolymers such as vinyl chloride-acrylate copolymers, a vinyl chloride-vinyl acetate-hydroxypropyl acrylate copolymer, a vinyl chloride-vinyl acetate-maleic anhydride copolymer and epoxy-modified vinyl chloride-vinyl acetate copolymers in addition to the above-described vinyl chloride-vinyl acetate-vinyl alcohol copolymer; phenoxy resins; epoxy resins; and acrylic resins. These resin matrixes may be used either alone or in combination of two or more of them. Further, these resins may be used together with other resins.

It is preferred that crosslinking is thermally carried out so as not to deteriorate other characteristics such as recording characteristics. Examples of the crosslinking agents include amino resins, phenolic resins, isocyanates, amines and epoxy resins. Examples of the amino resins include melamine resins (e.g., hexamethoxy-ethyl melamine), benzoguanamine and urea resins. An example of the phenolic resin includes trimethylol phenol. Examples of the isocyanates include 2,4- or 2,6-tolylene diisocyanate and 4,4'-diphenylmethane diisocyanate. Examples of the amines include polymethylenediamine, diaminophenylmethane, diaminophenylsulfone, o-toluidine and benzyldimethylamine. Examples of the epoxy compounds include triglycidyl isocyanurate, 3,4-epoxycyclohexyl-methyl-3,4-epoxycyclohexane carboxylate and epoxidized melamine resins. Further, acid anhydrides and methylacrylacid glycolate methyl ether may be used. It is preferred that crosslinking is carried out in the presence of the crosslinking agents and catalysts.

The crosslinking agents are used in an mount of 0.5 to 50.0 phr, preferably 1.0 to 30.0 phr. When the amount of the crosslinking agent is less than 0.5 phr, crosslinking is poorly made, and the crosslinked resins cannot be sufficiently prevented from being deteriorated when used over a long period of time. When the amount of the crosslinking agent is more than 50 phr, the crosslinking agent functions as a plasticizer, and recyclability is reduced.

Organic Low Molecular Weight Material (A)

Examples of the organic low molecular weight material (A) include aliphatic ketone compounds having a melting point of 50° C. or more, higher fatty acids having a melting point of 50° C. or more and ester compounds thereof, higher alcohols having a melting point of 50° C. or more and ester compounds thereof, and the solid solutions of these compounds. The term "solid solution" as used herein refers to that two or more independent organic low molecular weight materials (A) are dissolved in each other in the solid state. When the crystal structures of these materials are similar to each other, the solid solutions are easily formed. When the lengths of carbon chains are almost the same, the solid solutions of the aliphatic compounds are easily formed.

It is preferred that the organic low molecular weight materials (A) have a melting point of 50° C. or more. When the melting point is lower than 50° C., the materials are unstable at room temperature, and energy required for recording is changed during storage. As a result, the energy area for making the state transparent is shifted, and erasing cannot be made by a given energy.

Examples of the aliphatic ketone compounds having a melting point of 50° C. or more, the higher fatty acids having a melting point of 50° C. or more and esters thereof, and the higher alcohols having a melting point of 50° C. or more and esters thereof which can be used in the present invention include the following compounds.

Specific examples of the ketone compounds having a melting point of 50° C. or more include the following compounds.

| | | |
|---|---|---|
| (1) Dialkyl Ketone<br>$CH_3(CH_2)_{n-1}CO(CH_2)_{n-1}CH_3$ | | $n \geqq 8$ |
| (2) Methyl Alkyl Ketone<br>$CH_3CO(CH_2)_{n-3}CH_3$ | | $n \geqq 17$ |
| (3) Phenyl Alkyl Ketone<br>$C_6H_5CO(CH_2)_{n-1}CH_3$ | | $n \geqq 10$ |
| (4) Macrocyclic Ketone<br> 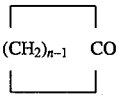 | | $n \geqq 10$ |
| (5) Symmetric α-Diketone<br>RCOCOR | $R = C_nH_{2n+1}$ | $n \geqq 7$ |
| (6) Acyloin<br>RCH(OH)COR | $R = C_nH_{2n+1}$ | $n \geqq 7$ |
| (7) Cyclic Acyloin<br> 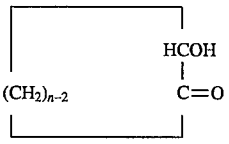 | | $n \geqq 12$ |
| (8) Ketone Dimer | $R = C_nH_{2n+1}$ | $n \geqq 14$ |

Specific examples of the higher fatty acids include myristic acid, pentadecylic acid, palmitic acid, margaric acid, stearic acid, nonadecanoic acid, eicosanic acid, heneicosanoic acid, behenic acid, lignoceric acid, pentacosanoic acid, cerotic acid, heptacosanoic acid, montanic acid, triacontanoic acid, nonacosanoic acid, melissic acid, trans-2-octadecenoic acid, trans-4-octadecenoic acid, 2-heptadecenoic acid, 11-icosenoic acid, 13-docosenoic acid and trans-8,trans-10-octadecadienoic acid.

Examples of the ester compounds of the higher fatty acids having a melting point of 50° C. or higher include the methyl esters and ethyl esters of the following fatty acids, and the esters of the following fatty acids with the following higher alcohols.

Methyl Ester and Ethyl Ester of Fatty Acid

| $C_n$ | Residue of Fatty Acid | Methyl Ester mp (°C.) | Ethyl Ester mp (°C.) |
|---|---|---|---|
| 22 | Behenic Acid | 53.3 | — |
| 23 | Tricosanoic Acid | 54.4 | 51.4 |
| 24 | Lignoceric Acid | 58.4 | 54.8 |
| 25 | Pentacosanoic Acid | 60.0 | 57.1 |
| 26 | Cerotic Acid | 63.4 | 60.2 |
| 28 | Octacosanoic Acid | 67.5 | 64.6 |
| 29 | Montanoic Acid | 68.8 | 66.6 |
| 30 | Melissic Acid | 71.7 | 68.4 |
| 32 | Dotriacotanoic Acid | 74.9 | 72.5 |
| 34 | Tetratriacontanoic Acid | 77.9 | 75.4 |
| 36 | Hexatriacontanoic Acid | 80.8 | 78.6 |
| 38 | Octatriacontanoic Acid | 83.1 | 80.5 |
| 46 | Hexatetracontanoic Acid | 91.0 | 90.5 |

Alkyl Ester of Fatty Acid

RCOOR' (n and m each is the number of carbon atoms of R and R')

| n | m | Compound |
|---|---|---|
| 16 | 15 | Pentadecyl Palmitate |
| | 16 | Hexadecyl Palmitate |
| | 18 | Octadecyl Palmitate |
| | 30 | Triacontyl Palmitate |
| 18 | 14 | Tetradecyl Stearate |
| | 16 | Hexadecyl Stearate |
| | 17 | Heptadecyl Stearate |
| | 18 | Octadecyl Stearate |
| | 26 | Hexacosyl Stearate |
| | 30 | Triacontyl Stearate |
| 22 | 22 | Docosyl Behenate |
| 24 | 24 | Tetracosyl Lignocerate |
| 30 | 30 | Myricyl Milissinate |

Examples of the higher alcohols having a melting point of 50° C. or more include the following compounds.

| | |
|---|---|
| (1) 1-Alkanol<br>$CH_3(CH_2)_{n-1}OH$ | $n \geqq 17$ |
| (2) 2-Alkanol<br>$CH_3CH(OH)(CH_2)_{n-3}CH_3$ | $n \geqq 20$ |
| (3) Cyclic Alcohol<br>$(CH_2)_{n-1}CH(OH)$ | $n \geqq 12$ |

Examples of the esters of the higher alcohols include the phthalic acid monoesters of primary alcohols having at least 12 carbon atoms.

Organic Low Molecular Weight Material.(B)

Compounds compatible with the resin matrixes can be used as the organic low molecular weight materials (B) capable of imparting the orientation to the melts of the organic low molecular weight materials (A). Examples of the compounds include sulfides, aliphatic dicarboxylic acids, saturated and unsaturated fatty acid disamides, aromatic bisamides, saturated and unsaturated aliphatic ureas and aromatic ureas.

The compounds which can be used in the present invention will be described in greater detail below.

Specific examples of the sulfides represented by formula of $HOOC(CH_2)_m\text{-}S\text{-}(CH_2)_nCOOH$ (wherein n and m each is an integer of 1 to 5) include (1,1'-dicarboxy)dimethyl sulfide, (2,2'-dicarboxy)diethyl sulfide (thiodipropionic acid), (3,3'-dicarboxy)dipropyl sulfide (1,2'-dicarboxy)-methylethyl sulfide (1,3'-dicarboxy)methylpropyl sulfide, (1,4'-dicarboxy)methylbutyl sulfide, (2,3'-dicarboxy)-ethylpropyl sulfide, (2,4'-dicarboxy)ethylbutyl sulfide and (5,5'-dicarboxy)dipentyl sulfide. Of these compounds, thiodipropionic acid is particularly preferred.

Specific examples of the aliphatic dicarboxylic acids represented by formula of $HOOC(CH_2)_{n-2}COOH$ include the following compounds.

| n | Name of Compound | n | Name of Compound |
|---|---|---|---|
| 2 | Oxalic Acid | 15 | Pentadecanediacid |
| 3 | Malonic Acid | 16 | Hexadecanediacid |
| 4 | Succinic Acid | 17 | Heptadecanediacid |
| 5 | Glutaric Acid | 18 | Octadecanediacid |
| 6 | Adipic Acid | 19 | Nonadecanediacid |
| 7 | Pimelic Acid | 20 | Eicosanediacid |
| 8 | Suberic Acid | 21 | Heneicosanediacid |
| 9 | Azelaic Acid | 22 | Docosanediacid |
| 10 | Sebacic Acid | 23 | Tricosanediacid |
| 11 | Undecanediacid | 24 | tetracosanediacid |
| 12 | Dodecanediacid | 26 | Hexacosanediacid |
| 13 | Tridecanediacid | 30 | Nonacosanediacid |
| 14 | tetradecanediacid | 34 | Dotriacontanediacid |

Examples of the saturated fatty acid bisamides include methylenebisstearic acid amide, ethylenebiscapric acid amide, ethylenebislauric acid amide, ethylenebisstearic acid amide, ethylenebisisostearic acid amide, ethylenebishydroxystearic acid amide, ethylenebisbehenic acid amide, hexamethylenebisstearic acid amide, hexa-methylenebisbehenic acid amide, hexamethylenebishydroxy-stearic acid amide, N,N'-distearyladipic acid amide and N,N'-distearylsebacic acid amide.

Examples of the unsaturated fatty acid bisamides include ethylenebisoleic acid amide, hexamethylenebisoleic acid amide, N,N'-dioleyladipic acid amide and N,N'-dioleylsebacic acid amide.

Examples of the aromatic bisamides include m-xylenebisstearic acid amide and N,N'-distearylisophthalic acid amide.

Examples of the saturated aliphatic ureas include N-methyl-N'-stearylurea and N-butyl-N'-stearylurea. An example of the saturated bisurea includes hexamethylene-bisstearylurea.

Examples of the unsaturated aliphatic ureas include N-butyl-N'-oleylurea, N-butyl-N'-palmitoleylurea and N-butyl-N'-myristoleylurea. Examples of the unsaturated aliphatic bisureas include hexamethylene-oleylurea, hexamethylenebispalmitoleylurea and hexamethylenebismyristoleylurea.

An example of the aromatic urea includes N-phenyl-N'-stearylurea. Examples of the aromatic bisureas include xylylenebisstearylurea, toluylenebisstearylurea, diphenylmethanebisstearylurea and diphenylmethane-dislaurylurea.

It is preferred that the organic low molecular weight material (A) and the organic low molecular weight material (B) are incompatible with each other, and a difference ($\Delta SP$) in solubility parameter therebetween is at least 1.20, preferably at least 1.70. The solubility parameter SP values of the organic low molecular weight materials were calculated by Fedors method described below. The determination of either being compatible or incompatible was determined by making the measurement with a differential scanning calorimeter (DSC). value $(\delta)=(E_v/v)^{1/2}=(\Sigma\Delta ei/\Sigma\Delta vi)^{1/2}$ $E_v$: Molar Vaporization Energy v: Molar Volume $\Delta ei$: Vaporization Energy of Atom or Atomic Group $\Delta vi$: Molar Volume of Atom or Atomic group It is necessary that the organic low molecular weight materials (B) capable of imparting the orientation to the melts of the organic low molecular weight materials (A) are selected from compounds which do not form a solid solution with the organic low molecular weight materials (A). The organic low molecular weight materials (B) capable of imparting the orientation to the melts of the organic low molecular weight materials (A) are usually selected from compounds which are different in the length of the carbon chain by at least 4 carbon atoms from the materials (A).

The organic low molecular weight materials (A) are used in an amount of preferably 5 to 100 parts by weight per 100 parts by weight of the resin matrix. When the amount of the organic low molecular weight material (A) is less than the above lower limit, a sufficient contrast cannot be obtained, while when the amount is more than the above upper limit, sufficient film forming properties cannot be obtained.

The organic low molecular weight materials (B) are used in an amount of preferably 0.5 to 50 parts by weight per 100 parts by weight of the resin matrix. When the amount of the organic low molecular weight material (B) is less than the above lower limit, the orientation cannot be imparted to the melts of the organic low molecular weight materials (A), while when the amount is more than the above upper limit, such an amount exceeds the amount of the material which is compatibilized with the resin matrix, the contrast is lowered, and sufficient film forming properties cannot be obtained.

The heat-sensitive recording layer is generally formed in the following manner. A solution containing the resin matrix and both the organic low molecular weight materials (A) and (B) dissolved therein is prepared. The solution is coated on a substrate and dried to form the heat-sensitive recording layer. Alternatively, a solution of the resin matrix is prepared by using a solvent which does not dissolve at least one of the organic low molecular weight materials (A) and (B), and the organic low molecular weight materials in the form of fine particles are dispersed therein. The resulting dispersion was coated on a substrate and dried to form the heat-sensitive recording layer.

Solvents for forming the heat-sensitive recording layer may be chosen according to the types of the resin matrixes and the organic low molecular weight materials. Examples of the solvents which can be used include tetrahydrofuran, methyl ethyl ketone, methyl isobutyl ketone, chloroform, carbon tetrachloride, ethanol, toluene and benzene.

The thickness of the heat-sensitive recording layer is usually 1 to 20 μm. When the thickness is larger than the above upper limit, the sensitivity is lowered, and a temperature gradient is produced in the thickness direction, while when the thickness is smaller than the above lower limit, the contrast is lowered. Particularly, when a high-speed energy applying means of 2 msec or below is used, it is preferred that the thickness of the heat-sensitive recording layer is 10 μm or less.

The recording medium of the present invention may optionally contain lubricants, antistatic agents, plasticizers, dispersants, stabilizers, surfactants and inorganic or organic fillers.

Further, an overcoat layer may be provided on the heat-sensitive recording layer through or without a subbing layer to protect the recording layer. The overcoat layer may be formed by using organic materials such as acrylic resins, silicone resins, fluororesins or epoxy resins, or inorganic materials such as $SiO_2$, SiO, MgO, ZnO, $TiO_2$, $Al_2O_3$, AlN or $Ta_2O_5$.

The overcoat layer can be formed by conventional coating methods or vacuum thin film forming methods (e.g., vacuum metallizing). The thickness of the overcoat layer is 0.1 to 5.0 μm, preferably 0.5 to 3.0 μm. When the thickness of the overcoat layer is smaller than the above lower limit, the protective effect is not sufficient, while when the thickness is larger than the above upper limit, an amount of energy required for recording is unnecessarily increased.

The reversible heat-sensitive recording medium of the present invention will be explained by the following examples. Parts given below are by weight, unless otherwise indicated.

A medium obtained by forming a reversible heat-sensitive recording layer having a thickness of 5 μm on a reflective metallic substrate was used as a sample. The medium was heated to bring it into an opaque state (this state is referred to as an "initial state"). The medium was then heated (contact time being 0.1 sec) by using a heat-sensitive paper static color forming device (a product of Okura Denki KK). Subsequently, the temperature was restored to ordinary temperature, and the optical reflection density obtained thereby was measured by using Macbeth reflection densitometer (Model RD-918).

The present invention is now explained in greater detail by reference to the following examples which, however, are not to be construed as limiting the invention in any way.

EXAMPLE 1

| Ingredient | Parts |
|---|---|
| Stearone ($[CH_3(CH_2)_{16}]_2CO$, mp: 91.0° C.) | 20 |
| Ethylenebiscapric Acid Amide (mp: 165.0° C.) | 1.0 |
| Vinyl Chloride-Vinyl Acetate Copolymer | 40.0 |
| Tetrahydrofuran | 244.0 |

The above solution was coated on a reflective metallic substrate (obtained by forming an Al layer having a thickness of 0.1 μm on a polyethylene terephthalate film having a thickness of 188 μm by vacuum metallizing) by means of wire bar coating and dried by heating to form a reversible heat-sensitive recording layer having a thickness of 10 μm.

EXAMPLE 2

A reversible heat-sensitive recording layer was formed in the same manner as in Example 1 except that behenic acid (mp: 80.0° C.) was used in place of stearone.

EXAMPLE 3

A reversible heat-sensitive recording layer was prepared in the same manner as in Example 1 except that behenyl alcohol (mp: 76.5° C.) was used in place of stearone.

EXAMPLE 4

A reversible heat-sensitive recording layer was prepared in the same manner as in Example 1 except that diphenylmethanebislaurylurea (mp: 215.0° C.) was used in place of ethylenebiscapric acid amide.

EXAMPLE 5

A reversible heat-sensitive recording layer was prepared in the same manner as in Example 1 by using the following ingredients.

| Ingredient | Parts |
|---|---|
| Melissic Acid $C_{29}H_{59}COOH$ | 15 |
| Hentriacontanoic Acid $C_{30}H_{61}COOH$ | 15 |
| Methylenebisstearic Acid Amide $(C_{17}H_{35}CONH)_2(CH_2)$ | 10 |

-continued

| Ingredient | Parts |
|---|---|
| Vinyl Chloride-Vinyl Acetate Copolymer | 100 |
| Tetrahydrofuran | 480 |

COMPARATIVE EXAMPLE 1

A reversible heat-sensitive recording layer was prepared in the same manner as in Example 1 by using the following ingredients.

| Ingredient | Parts |
|---|---|
| Behenic Acid $C_{21}H_{43}COOH$ | 80 |
| Eicosanediacid $HOOC(CH_2)_{18}COOH$ | 20 |
| Vinyl Chloride-Vinyl Acetate Copolymer | 250 |
| Tetrahydrofuran | 1,400 |

COMPARATIVE EXAMPLE 2

A reversible heat-sensitive recording layer was prepared in the same manner as in Example 1 by using the following ingredients.

| Ingredient | Parts |
|---|---|
| Stearic Acid $C_{17}H_{35}COOH$ | 80 |
| Behenic Acid $C_{21}H_{43}COOH$ | 20 |
| Vinyl Chloride-Vinyl Acetate Copolymer | 250 |
| Tetrahydrofuran | 1,400 |

The recording mediums obtained in the above Examples and Comparative Examples were tested. The temperature region (transparentizing temperature region) wherein the reflection density is within the range of from the maximum transparency to (the maximum transparency-0.1) is shown in Table 1 below.

TABLE 1

| | Transparentizing Temperature Region (°C.) | Margin of Transparentizing Temperature (°C.) | Difference in SP value |
|---|---|---|---|
| Example 1 | 75–110 | 35 | 1.62 |
| Example 2 | 70–100 | 30 | 1.22 |
| Example 3 | 65–105 | 40 | 1.32 |
| Example 4 | 75–105 | 30 | 1.22 |
| Example 5 | 80–100 | 20 | — |
| Comparative Example 1 | 70–83 | 13 | 0.94 |
| Comparative Example 2 | 65–68 | 3 | 0.09 |

EXAMPLE 6

(A difference in SP value being 1.31)

| Ingredient | Parts |
|---|---|
| Laurone $(CH_3(CH_2)_{10}CO(CH_2)_{10}CH_3)$ | 30 |
| Eicosanediacid | 10 |
| Vinyl Chloride-Vinyl Acetate-Vinyl Alcohol Copolymer | 60 |

-continued

| Ingredient | Parts |
|---|---|
| Colonate L (75% isocyanate crosslinking agent) | 8 |
| Tetrahydrofuran | 400 |

The above solution was coated on a reflective metallic substrate (obtained by forming an Al layer having a thickness of 0.1 μm on a polyethylene terephthalate film having a thickness of 188 μm by vacuum metallizing) by means of wire bar coating and dried by heating to obtain a heat-sensitive recording layer having a thickness of 5 μm. Subsequently, aging was carried out at 40° C. for 24 hours to cure the resin matrix. Further, a thermosetting silicone resin layer (having a thickness of 2 μm) as the protective layer was formed on the heat-sensitive layer.

EXAMPLE 7

(A difference in SP value being 3.61)

A reversible heat-sensitive recording material was prepared in the same manner as in Example 6 except that behenic acid was used in place of laurone, and thiodipropionic acid was used in place of eicosanediacid.

EXAMPLE 8

A reversible heat-sensitive recording material was prepared in the same manner as in Example 6 except that an epoxy resin crosslinking agent (Tetrad-c) was used in place of Colonate L.

COMPARATIVE EXAMPLE 3

A reversible heat-sensitive recording material was prepared in the same manner as in Example 6 except that Colonate L was omitted.

COMPARATIVE EXAMPLE 4

A reversible heat-sensitive recording material was prepared in the same manner as in Example 7 except that Colonate L was omitted.

COMPARATIVE EXAMPLE 5

A reversible heat-sensitive recording material was prepared in the same manner as in Example 8 except that Tetrad-c was omitted.

Test Method

The recyclability of each of the reversible heat-sensitive recording materials obtained in Examples 6 to 8 and Comparative Examples 3 to 5 was evaluated in the following manner.

A line type head of 8 dot/mm was used. While the applied time was changed under a given applied voltage (pulse width: 2.0 ms), the applied time which showed the maximum opaque degree was determined. The condition was referred to as the applied condition. After printing, the samples were subjected to hot stamping by using a hot stamp, while the stamping temperature was changed under such conditions that the contact time was 0.1 sec, and the contact pressure was 1 kg/cm$^2$, thereby determining the temperature at which the maximum transparency could be obtained. The condition was referred to as the erasing condition. Printing and erasing were repeatedly made under these conditions. When each of printing and erasing was made once, it was referred to as one recycle. The opaque degree and the transparency were measured by Macbeth reflection densitometer (RD-914) and evaluated by reflection temperature. A smaller numerical value shows the opaque state (while a larger numerical value shows the transparent state). The results obtained are shown in Table 2 below.

TABLE 2

| | Initial | | After 1,000 recycles | |
|---|---|---|---|---|
| | Printing Density | Contrast (OD Erasing - OD Printing) | Printing Density | Contrast (OD Erasing - OD Printing) |
| Example 6 | 0.60 | 1.00 | 0.70 | 0.80 |
| Example 7 | 0.50 | 0.80 | 0.60 | 0.70 |
| Example 8 | 0.60 | 0.90 | 0.75 | 0.75 |
| Comparative Example 3 | 0.60 | 1.00 | 1.30 | 0.05 |
| Comparative Example 4 | 0.50 | 0.80 | 1.20 | 0.02 |
| Comparative Example 5 | 0.60 | 0.90 | 1.35 | 0.04 |

As described above, the recording medium of the present invention contains the organic low molecular weight material (B) capable of imparting the orientation to the melt of the organic low molecular weight material (A) dispersed in the resin matrix, whereby the transparentizing temperature region can be widened, and erasing can be easily made by a thermal head. Further, when the resin matrix is crosslinked, recyclability can be improved.

While the present invention has been described in detail and with reference to specific embodiments thereof, it is apparent to one skilled in the art that various changes and modifications can be made therein without departing from the spirit and the scope of the present invention.

What is claimed is:

1. A reversible heat-sensitive recording medium comprising a support and having thereon a recording layer comprising:

(i) a resin matrix, (ii) at least one organic low molecular weight material (A) which is at least partially insoluble in the resin matrix, exists in the resin matrix by phase separation, and is dispersed as particles in the resin matrix, and (iii) an organic low molecular weight material (B) soluble in the resin matrix, wherein the organic low molecular weight material (B) can impart an orientation to the melt of the organic low molecular weight material (A) at a temperature from $T_1$ to $T_2$, wherein $T_1$ is the melting point of the organic low molecular weight material (A) in the resin matrix, and $T_2$ is the melting point of the organic low molecular weight material (B) in the resin matrix, wherein said organic low molecular weight material (A) is an aliphatic ketone compound having a melting point of 50° C. or more, and said organic low molecular weight material (B) is at least one member selected from the group consisting of sulfides, aliphatic dicarboxylic acids, saturated or unsaturated fatty acid bisamides, aromatic bisamides, saturated and unsaturated aliphatic ureas or bisureas, and aromatic ureas.

2. A reversible heat-sensitive recording medium as claimed in claim 1, wherein said resin matrix is at least one member selected from the group consisting of vinyl chloride copolymers, phenoxy resins, epoxy resins and acrylic resins.

3. A reversible heat-sensitive recording medium as claimed in claim 1, wherein said resin matrix is heat-crosslinked by a crosslinking agent.

4. A reversible heat-sensitive recording medium as claimed in claim 1, wherein the particles of the organic low molecular weight material (A) comprise at least two compounds which can form a solid solution.

5. A reversible heat-sensitive recording medium as claimed in claim 1, wherein said organic low molecular weight material (A) is used in an amount of from 5 to 100 parts by weight per 100 parts by weight of the resin matrix.

6. A reversible heat-sensitive recording medium as claimed in claim 1, wherein said organic low molecular weight material (B) is used in an amount of from 0.5 to 50 parts by weight per 100 parts by weight of the resin matrix.

7. A reversible heat-sensitive recording medium as claimed in claim 1, wherein said organic low molecular weight materials (A) and (B) are incompatible with each other, and difference in solubility parameter therebetween $\Delta SP$, is at least 1.20.

8. A reversible heat-sensitive recording medium as claimed in claim 7, wherein said $\Delta SP$ is at least 1.70.

9. A reversible heat-sensitive recording medium as claimed in claim 1, wherein the aliphatic ketone compound having a melting point of 50° C. or more is selected from the group consisting of a dialkyl ketone, a phenyl alkyl ketone, a symmetric $\alpha$-diketone, an acyloin and a ketone dimer.

* * * * *